US005592929A

United States Patent [19]

Hoyt, Jr.

[11] Patent Number: 5,592,929

[45] Date of Patent: Jan. 14, 1997

[54] RECURVE BOW ALIGNMENT

[76] Inventor: Earl H. Hoyt, Jr., 11510 Natural Bridge Rd., St. Louis, Mo. 63044

[21] Appl. No.: 398,148

[22] Filed: Mar. 3, 1995

[51] Int. Cl.[6] ..... F41B 5/00

[52] U.S. Cl. ..... 124/23.1; 124/88

[58] Field of Search ..... 124/23.1, 25.6, 124/86, 88

[56] References Cited

U.S. PATENT DOCUMENTS 3,814,075 6/1974 Hoyt ..... 124/88 X
4,091,790 5/1978 Hoyt ..... 124/88 X
5,280,779 1/1994 Smith ..... 124/88
5,411,008 5/1995 Hsu ..... 124/23.1
5,464,001 11/1995 Peck ..... 124/25.6

*Primary Examiner*—John A. Ricci
*Attorney, Agent, or Firm*—Polster, Lieder, Woodruff & Lucchesi, LC

[57] ABSTRACT

Apparatus and method for aligning the limbs of a recurve bow, the limbs being mounted in pockets at ends of a handle, the limbs having a slot in a butt end parallel edges of which embrace a pull-weight adjusting spool. Each of the pockets has a channel in which a button, mounted on the limb, has a head that floats in the channel. Set screws mounted in the side walls of the channel bear against opposite edge surfaces of the button, whereby the limb can be caused to move about the adjusting spool as a pivot to bring the two limbs into alignment.

9 Claims, 2 Drawing Sheets

RECURVE BOW ALIGNMENT

BACKGROUND OF THE INVENTION

This invention relates to recurve bows and to a problem peculiar to traditional recurve bows. It is directed to the alignment of the upper and lower limbs. Recurve bows commonly have upper and lower laminated composite limbs, mounted in upper and lower pockets of a metal handle. The pockets open forwardly in the bow in use, i.e. in the direction of travel of the arrow, and the limbs and pockets will be referred to as "front" or "forward" or "rear" or "rearward" to indicate that they are positioned in the direction of flight of an arrow or in a direction toward the bow string, respectively.

It is essential that the grooves in which the bow string rides in a conventional recurve bow be accurately aligned. Misalignment can not only reduce accuracy in shooting targets but can even lead, on a hot day, when the limbs may tend to soften, to the string's slipping out the grooves altogether, leading to great distortion of the limb or limbs.

When the handle is made of magnesium, limbs can be mounted in the handle, the handle can be mounted in a fixture, and the handle can be bent to align the limb tips, and because magnesium is reasonably malleable, it will retain its new shape. However, when the handle is made of tempered aluminum, for example, T-6 aluminum 6061, the metal has a substantial memory. Even though the handle is machined, the limbs are not necessarily in perfect alignment due, among other things, to stress release resulting from metal removal. If such a handle is distorted beyond its elastic limit, it will remain in the distorted shape, but it is liable then to be distorted too far. Accordingly, it is extremely difficult to obtain perfect alignment with a tempered aluminum handle.

One of the objects of this invention is to provide means for aligning limbs of a recurve bow which are positive, accurate, usable with any type of pocketed handle, and require no distortion of the handle.

Another object is to provide such means that are easy to employ, do not add unduly to the cost of producing the bow, and reduce the labor required to align the limbs.

Other objects will become apparent to those skilled in the art in the light of the following description and accompanying drawing.

SUMMARY OF THE INVENTION

In accordance with this invention, generally stated, in a recurve bow with upper and lower limbs and a handle having a limb-receiving pocket at each end, an adjusting bolt or spool embraced by legs of a slot in the butt end of each limb, and a channel in a heavy bottom wall of the pocket, a button is mounted on the limb, the button having a head with edge surfaces facing oppositely disposed side walls of the channel. The head of the button floats in the channel, i.e. is spaced from the side walls a predetermined distance sufficient to permit the desired amount of lateral movement about the adjusting spool as a center, to align the two limbs. In the embodiment described, the channel is defined not only by the side walls but by facing, over-hanging ledges defining a passage between their facing edges and between rear surfaces of the ledges and the forward surface of a channel bottom wall. The button has a neck, fixed at one end in the rear surface of the limb and carrying the head at its other end. The neck is spaced from the facing surfaces of the ledges and the head is spaced from the rear surfaces of the ledges when the bow is strung.

Set screws mounted in the heavy bottom wall of the pocket, extend laterally through the side walls of the channel and engage the edge surface or surfaces of the head on opposite sides thereof, the set screws being aligned with one another but oppositely disposed. The set screws are manipulable from outside the handle.

To align the limbs, the handle is clamped in a fixture with the axes of rotation of the two, spaced adjusting spools aligned with at least one fixed mark immediately beyond the outer tip of the limb and the groove that bisects the tip of the limb in the lengthwise direction of the bow. The limb is then moved into alignment with the fixed mark by screwing in the set screw on one side and backing off the set screw on the other side until the limb is aligned with its contiguous mark. That limb is then perfectly aligned with the vertical axes of the adjusting spools. The set screws are then fixed in position. There is no obstruction between the adjusting spool and the button to prevent or impede the rotation of the limb about the adjusting spool. Either marks can be provided at both ends, and both limbs aligned while the handle is in one position in the fixture, or the handle can be reversed, and the other limb aligned with the axes of rotation of the adjusting spools as the first limb was.

Because when adjustment of the pull weight is made, or the bow is strung, the limb rocks about a surface of the limb substantially coincident with the center line of the button, and the button floats in the channel, the adjustment of the bow pull weight by the movement of the adjusting spool or the stringing of the bow does not misalign the limbs.

Preferably, the channel is T-shaped in elevation, and the button head has an annular cylindrical surface of substantial axial extent against diametrically opposite sides of which the set screws bear.

The head can be square or otherwise polygonal, or simply have opposite parallel flat surfaces against which the set screws bear, in which case the inner ends of the set screws can be rounded.

A forward or upper surface of the channel bottom wall between the side walls can be provided with a dimple, and the button can be provided with a spring-loaded detent merely as a means to keep the limb from falling out when the bow is unstrung. Once the bow is strung, the forward surface of the limb adjacent the slot in each limb is forced against a rearward surface of the adjusting spool, the limbs are held tightly in the pockets and the button is moved against the bias of the detent to a "floating" condition.

If the pockets have side walls, they must be spaced apart sufficiently to accommodate the lateral rotation of the limb in response to the adjusting of the set screws.

The handle is sometimes referred to as metal, because that is presently the conventional material from which handles are made. It can be seen that the adjusting means of this convention can be used with handles of any composition including wood and plastic.

IN THE DRAWINGS

In the drawing, FIG. 1 is a view in side elevation of a conventional recurve bow equipped with adjusting means of this invention;

DESCRIPTION OF THE PREFERRED EMBODIMENT

Figure 1:
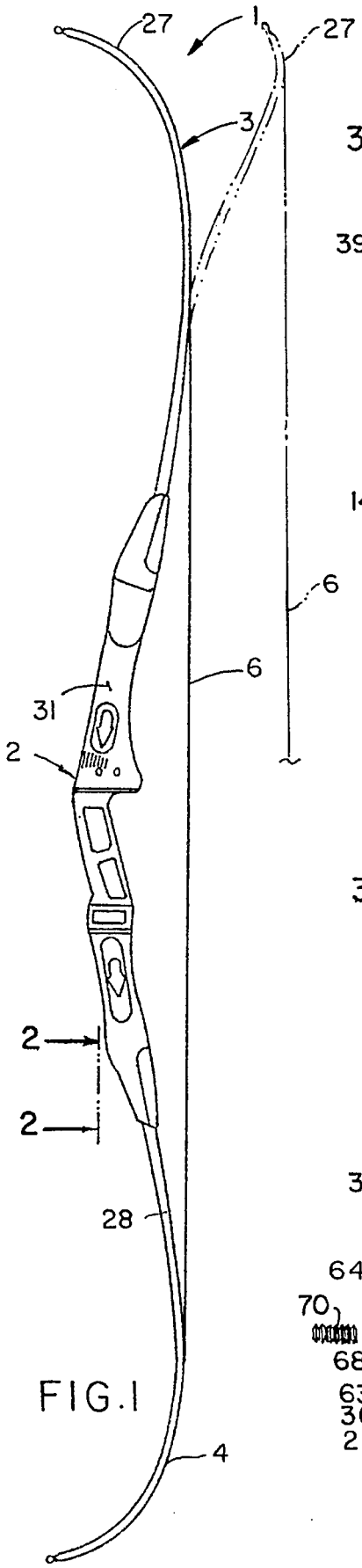
Figure 2:
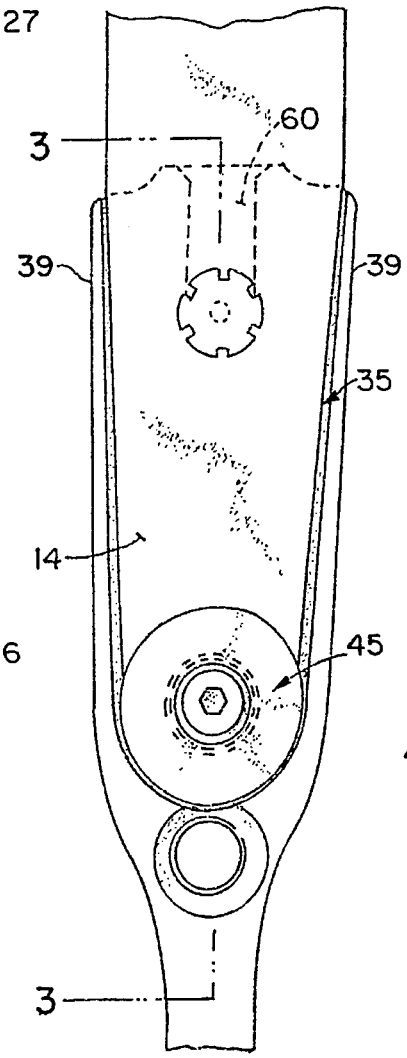
FIG. 2 is a fragmentary view in front elevation, in the direction indicated by the line 2—2 of FIG. 1.

Referring now to the drawing for one illustrative embodiment of this invention, reference numeral 1 indicates a recurve bow, conventional except for the adjusting mechanism of this invention. The bow 1 is made up of a handle 2, an upper limb 3, a lower limb 4 and a bow string 6. The bow string 6 is seated in the usual lengthwise extending groove running along a rear surface of a reflex section 27 of the bow limb.

The upper and lower limbs are symmetrical about a long dimension, and are, accordingly, interchangeable. A description of one, therefore, is sufficient. Although the handle 2 is not symmetrical, it is provided at each end with an identical pocket 35.

Figure 7:
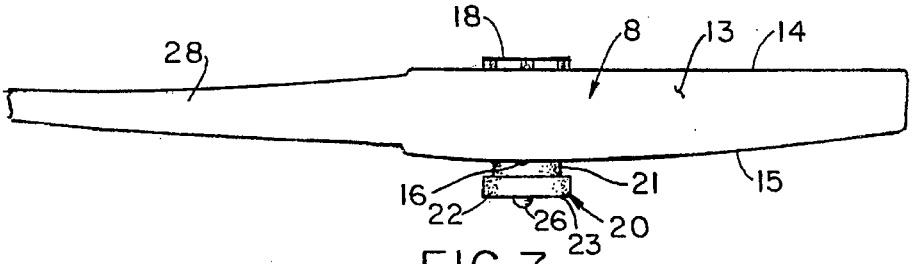
FIG. 7 is a view of a limb, showing a butt end equipped with the button of FIGS. 4 and 4A.
Figure 8:
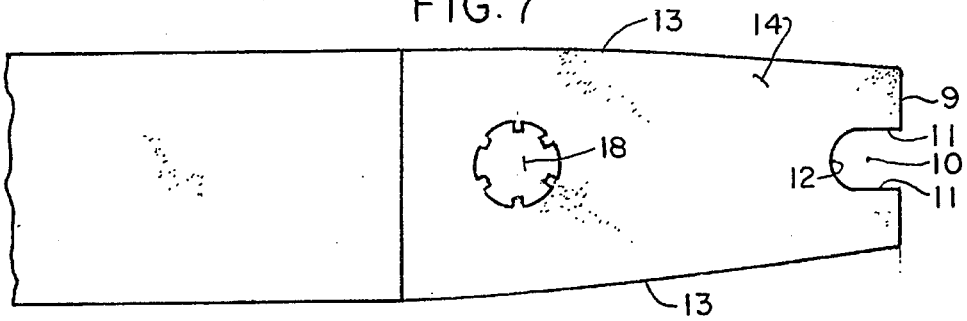
FIG. 8 is a top plan view of FIG. 7.
Figure 9:
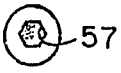
FIG. 9 is a top plan view of a locking screw.
Figure 10:
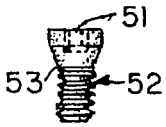
FIG. 10 is a view in side elevation of the locking screw of FIG. 9.
Figure 11:
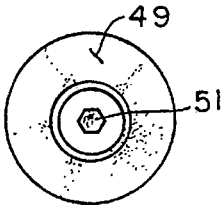
FIG. 11 is a top plan view of an adjusting spool.

Each limb has a butt or pocket end 8, with a square end 9, through which a U-shaped slot 10 extends. The U-shaped slot 10 is defined by side edges 11 and a bridging end wall 12. The limb is wide relative to its thickness. The butt end 8 of the limb is relatively thick compared with a deflex section 28 and the reflex section 27 of the limb. Side walls 13 of the limb tend convergently from the deflex section 28 to the end 9 so that the limb tapers in width from the deflex section 28 convergently to the end 9. A rear surface 15 of the butt end of the limb slopes convergently toward a generally flat front surface 14 from a bearing area 16 toward the end 9, and from the bearing area 16 toward the deflex section 28, so that in thickness, the butt end 8 tapers from the bearing area 16 convergently toward the end 9, and from the bearing area 16 convergently toward the deflex section 28, all as shown particularly in FIGS. 8 and 7 respectively.

Figure 3:
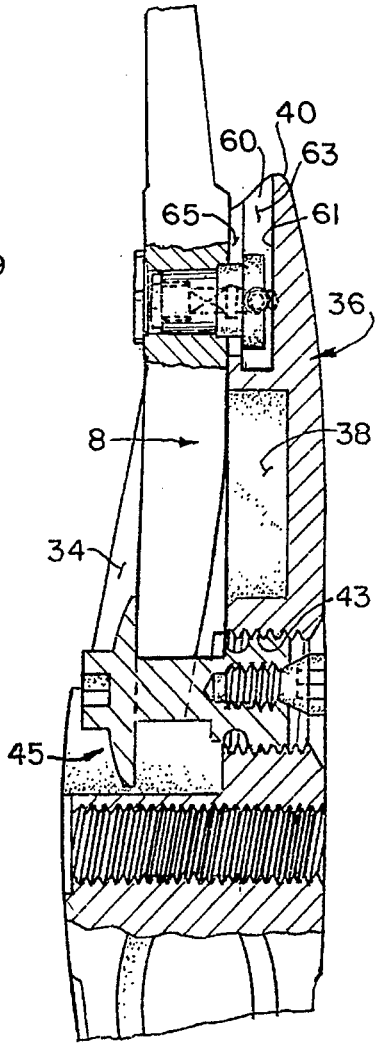
FIG. 3 is a sectional view taken along the line 3—3 of FIG. 2.
Figure 4:
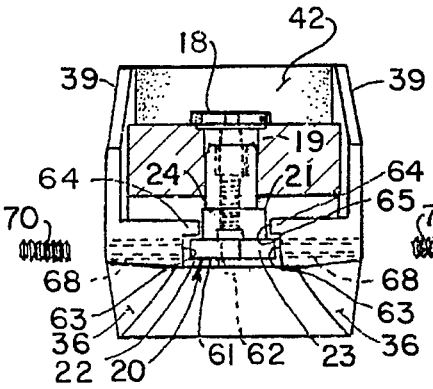
FIG. 4 is a view in end elevation of the handle, showing a pocket and a bow limb, in cross section, showing one embodiment of adjustment means of this invention.
Figure 4A:
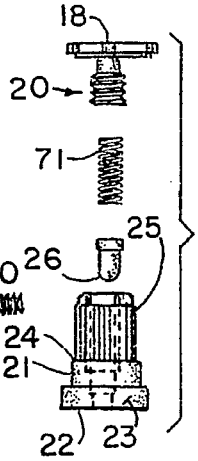
FIG. 4A is an exploded view of a button and detent arrangement.
Figure 5:
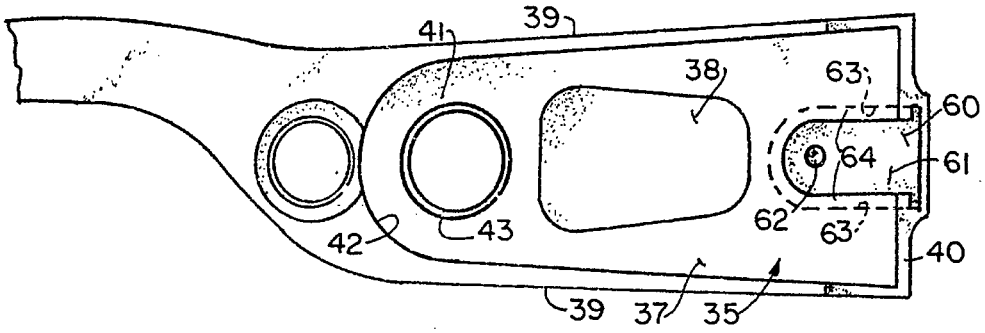
FIG. 5 is a fragmentary top plan view of the handle showing the pocket of FIG. 4.
Figure 6:
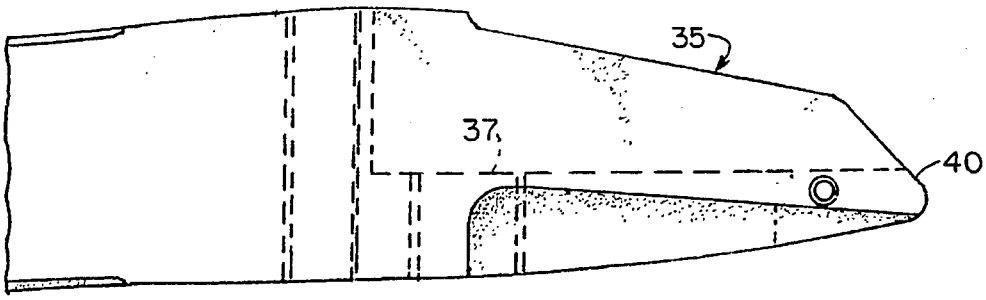
FIG. 6 is a fragmentary view in side elevation of FIG. 5.

A button 20, shown in detail in FIG. 4A, is mounted in the bearing area 16 of the butt end 8 of the limb. The button 20 has a head in the form of an annular flange 22 with a cylindrical circumferential surface 23, a neck 21, and a stem 25. The stem 25 is grooved or knurled and force fit into a passage through the bearing section 16 of the end 8 between the rear surface 15 and the forward surface 14, substantially perpendicularly to the surface 14 and on a longitudinal center line of the limb. That center line extends between a central point of the semi-circular wall 12 of the slot 10 and the groove at the limb tip. A passage, stepped as indicated in FIG. 4A, extends through the button, and is threaded to receive a corresponding threaded shank of a bolt 18. In this embodiment, a detent 62 seated in the passage in the button, is biased by a spring 71 to project from the head 23, as shown particularly in FIGS. 3 and 4.

Each of the limb pockets 35 in the handle has a heavy bottom wall 36, a forward surface of which is generally planar, shown in the illustrations as having a weight reducing cavity 38 in it, side walls 39, an open outer end 40 and an inner end 41 defined by a semi-circular wall 42.

Figure 12:
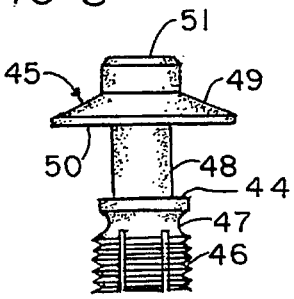
FIG. 12 is a view in side elevation of the adjusting screw of FIG. 11.
Figure 13:
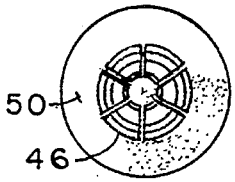
FIG. 13 is a bottom plan view of the adjusting spool of FIGS. 11 and 12.

A tapped hole 43 through the bottom wall 36 near the inner end 41 of the pocket receives a split screw section 46 of an adjusting bolt or spool 45. The adjusting spool 45 has, immediately above the threaded section 46, a reduced section 47 which includes a flange 44 of a diameter to clear the hole 43, to permit the spool to be screwed into the hole 43 beyond the threaded section 46. A cylindrical post section 48, of smaller diameter than the flange 44, extends between the flange 44 and an under or rear surface 50 of a cap 49. The surface 50 of the cap 49, which is integral with the post 48, extends radially substantially beyond the circumference of the threaded section 46, as shown particularly in FIGS. 3 and 12. The cap 49 has integral with it a boss with an Allen wrench socket 51 in it. The split screw section 46 of the spool 45 has an internally threaded passage in it, to receive an externally threaded shank of a locking screw 52. The locking screw 52 has a tapered head 53, and an Allen wrench socket 57. The spool 45 is locked in position by means of the screw 52, the tapered head of which spreads segments of the split screw when the locking screw is tightened, as will be appreciated from FIGS. 12 and 13.

A channel 60 extends from the outer end 40 of the pocket in a direction toward the inner end 41, midway between the walls 39. The channel 60 is defined by a forward bottom surface 61, in which a dimple 62 is provided to receive the detent 26, facing surfaces of side walls 63, rear surfaces of overhanging ledges 64, and facing surfaces 65 of the overhanging ledges. In this embodiment, the facing surfaces 65 are on the order of 0.040" farther apart than the diameter of the neck 21, the facing surfaces of side walls 63 are on the order of 0.040" farther apart than the diameter of the head 22, and the distance between the forward surface 61 and the rearward surfaces of the ledges 64 is sufficiently greater than the axial reach of the cylindrical surface 23 to permit the button head to float in the channel no matter what the adjustment of the bow weight by movement of the adjustment spool 45, when the bow is strung.

Tapped holes 68 extend from the outer side surfaces of the heavy bottom 36 through the facing side walls 63 of the channel 60. The holes 68 are aligned with one another, are aligned diametrically with the head or flange 22, and are aligned with respect to the cylindrical surface 23 substantially centrally of the axial reach of the surface 23. Set screws 70, threaded in the holes 68, are of a length to permit their manipulation from the outer ends of the holes 68, and to engage the surface 23 of the flange or head 22. The outer ends of the set screws 70 can be provided with slots or Allen wrench sockets to receive a suitable tool for their adjustment. Preferably, the button head and set screws are case hardened to minimize wear and distortion.

As has been indicated, the clearance between the outer surface of the neck 21 and the facing walls 65, and between the inner surfaces of the side walls 63 and the cylindrical surface 23 of the flange 22 are on the order of 0.020", for a total potential movement of 0.040", although a greater clearance can be provided if it is found necessary. The distance between the facing surfaces of the side walls 39 and the contiguous edge 13 of the limb should be on the order of 0.030" to 0.040" on each side, because the movement of the limb in response to the adjustment by the set screws 70 will be magnified to some extent.

The walls defining the U-shaped slot 10 embrace the post 48 closely. In aligning the limbs, the handle is put into a fixture with the axes of rotation of the two adjusting spools aligned with a bench mark just beyond the reach of a limb. A limb, either a master limb or the limb that is to be inserted in the handle, is mounted in the pocket, with the walls of the limb slot closely embracing the post of the adjusting spool, and the screws 70 are moved in or out as the case may be to align the limb tip and groove with the bench mark. The screws are then snugged, backed off just enough to permit the button to slide in and out between them, and fixed in position while the limb is held in alignment. The handle can then be turned and the other limb aligned. Alternatively, bench marks can be provided at each end of the handle, and the two limbs can be aligned with the handle in one position in the fixture.

Because the limbs themselves are accurately dimensioned with respect to the tip's being aligned with the center line of the limb slot and the perpendicular center line of the button, once the set screws have been fixed, the mounted limb or a different limb can be put into place, and still be aligned.

The set screw 70 can be held in place by the use of jam screws, or drops of adhesive, or even by virtue of a tight fit in the threaded holes through which they extend.

It can be seen from the foregoing description that the lateral adjustment of the set screws permits rotatable alignment of the theoretical center line of the bow limbs to a central plane defined by and aligned with the projected center line of the limb weight adjusting bolts or spools at the inboard end of each pocket, the center line of said bolts being normal to the planar forward surface of the bottom wall of the pockets.

Numerous variations in the construction and method of adjustment of this invention will occur to those skilled in the art in the light of the foregoing disclosure. Merely by way of example and not of limitation, the clearances between the walls of the channel and the button can be made greater or less, depending upon the degree of adjustment necessary for alignment. Movement of the limb, of course, is multiplied at its tip, so that a movement of 0.040" at the button may produce a movement of 0.400" at the tip. The dimensions of the button surfaces can be varied. In the preferred embodiment, the axial reach of the surface 23 is on the order of 0.075". Because the button is mounted at the bearing area 16 of the butt end of the bow, the in and out movement of the adjusting spool will produce a certain slight amount of rocking of the button with respect to the channel 60, but little or no translation. Because the button stem 25 is force fit or epoxied into place, the orientation of the button can be controlled. Accordingly, the head of the button, against which the screws 70 bear, can be made of a different configuration from the cylindrical configuration described. If the head is made with parallel flat sides, the set screws can be made with rounded ends to facilitate the rocking of the head, just as the square flat ends of the set screws in the illustrative embodiment meet the curved surface of the cylindrical wall of the head tangentially. The cross sectional configuration of the channel can be varied, as long as the button is free to move in response to the adjustment of the set screws. The provision of overhanging ledges and a head with a flange that underlies the ledges has the advantage of inhibiting unintentional dislodgment of the limb from the pocket, but as far as the adjustment of the angularity of the limb is concerned, a simple post, extending into a straight-sided channel, will work. The post can, like the head, be variously configured. Metal pads or shoes on either side of the limb itself can be moved by screws extending through the side walls 39 of the pocket. This arrangement is not preferred, however, because first, the side walls of the limb are not accurately dimensioned as compared with the button, which in practice is sized exactly and located within 0.001" with respect to the full centerline of the limb, and second, the aligning means are more subject to the flexure of the limb than is the button. The bench marks may take the form of or be supplemented by stops against which the bow tips can be brought to bear, or a laser beam with which the bow grooves can be aligned, or even a stretched line, extending across the two centerlines of the adjusting spools and over the grooves when they are aligned. These are merely illustrative.

I claim:

1. In a recurve bow having a handle and upper and lower limbs, said handle having upper and lower limb-receiving pockets and, in each, a pull-weight adjusting spool fixed against lateral movement with respect to said pocket and located at an inner end of said pocket, each of said limbs having at a butt end thereof slot means for closely receiving said pull-weight adjusting spool, the improvement comprising means for pivoting said limb around said spool and for holding said limb in a desired angular position with respect to said spool.

2. A recurve bow with upper and lower limbs, an elongated handle having a limb-receiving pocket at both ends of said handle, said pocket having a heavy bottom wall, said bottom wall having an internally threaded hole in it and a limb pull weight adjusting spool threadedly mounted in said hole, a limb sized at one end to fit within said pocket, said limb having a slot opening toward said spool, said slot being defined by walls embracing said spool, and means mounted in said pocket for causing said limb to pivot about said spool, and for locking said limb in a selected angular position with respect to said spool.

3. The bow of claim 2 wherein said pocket has a planar bottom surface, said limb has mounted on it and projecting from one side thereof a fitting, said fitting having a surface extending perpendicular to said planar bottom surface, and said means for causing said limb to pivot comprising set screw means threadedly mounted in and projecting through a wall of said pocket and engaging said fitting.

4. The bow of claim 3 including a channel defined by a channel bottom surface and facing side walls, in which channel said limb fitting rides, said set screws extending through said side walls and into said channel.

5. The bow of claim 4 wherein said channel is undercut, defined in part by overhanging ledges facing one another, and said firing is T-shaped in elevation, with an annular flange slideably fitting between said overhanging ledges and said bottom and with a neck extending between said limb and said flange and between facing edges of said ledges, said flange having a substantial axially extending surface and said set screws bearing on said surface on diametrically opposite sides.

6. In a recurve bow including a handle and upper and lower limbs, said handle being elongate and having oppositely disposed pockets for receiving axially inner ends of said limbs, said pockets being defined by side walls and a heavy bottom wall; a pull weight adjusting spool threadedly mounted in said bottom near an axially inboard end of said pocket, said spool having a cap with a radially extending flange and a central cylindrical post extending between said flange and a threaded end of said spool, and an undercut channel extending axially in said bottom wall, said channel being defined by a bottom surface, channel side surfaces, and overhanging surfaces spaced from and facing said bottom surface and adapted to receive between them and said channel bottom surface a bow limb fitting, said limbs having a slot defined by walls proportioned closely to receive said adjusting spool post; the improvement comprising said bow limb fitting having a side surface proportioned to provide a predetermined clearance between it and said channel side surfaces laterally of said limb, set screw means threadedly mounted in said handle pocket bottom wall on opposite side of said channel, extending laterally of said channel and positioned to engage said surface of said limb fitting on opposite sides thereof, said pocket side walls being spaced apart sufficiently to permit movement of said limb laterally, said limb being free to pivot around said adjusting spool post to the extent that said limb fitting is moved by said set screw means.

7. The improvement of claim 6 wherein said undercut channel is T-shaped, said surfaces comprising parallel side walls and overhanging ledges with surfaces facing and substantially parallel to the said channel bottom wall surface.

8. The improvement of claim 7 wherein said limb fitting is a stepped cylindrical button, with a neck extending between facing surfaces of the said ledges and a cylindrical head with a peripheral annular surface engaged by said set screws.

9. The method of aligning limbs of a recurve bow having a handle, said handle having upper and lower limb receiving pockets and, in each pocket, a pull-weight adjusting spool located at an inner end of said pocket and having a centerline, said limbs having at butt ends thereof slot means for closely receiving said spool, said method comprising aligning the centerlines of said spools with a bench mark, pivoting a limb about one of said spools until an outer end of said limb is aligned with the centerlines of said spools and said bench mark, and maintaining said limb in said aligned condition.

* * * * *

UNITED STATES PATENT AND TRADEMARK OFFICE

CERTIFICATE OF CORRECTION

PATENT NO. : 5,592,929

DATED : January 14, 1997

INVENTOR(S) : Earl H. Hoyt, Jr.

It is certified that error appears in the above-identified patent and that said Letters Patent is hereby corrected as shown below:

Column 6, line 53 delete "firing" and insert --fitting--.

Signed and Sealed this

Fifth Day of May, 1998

Bruce Lehman

*Attest:*

BRUCE LEHMAN

*Attesting Officer*

*Commissioner of Patents and Trademarks*